US006470971B1

(12) United States Patent
Bridges

(10) Patent No.: US 6,470,971 B1
(45) Date of Patent: Oct. 29, 2002

(54) TUBING HEAD CONTROL AND PRESSURE MONITOR DEVICE

(75) Inventor: Charles D. Bridges, Cypress, TX (US)

(73) Assignee: ABB Vetco Gray Inc., Houston, TX (US)

( * ) Notice: Subject to any disclaimer, the term of this patent is extended or adjusted under 35 U.S.C. 154(b) by 5 days.

(21) Appl. No.: 09/711,771

(22) Filed: Nov. 13, 2000

Related U.S. Application Data

(60) Provisional application No. 60/165,507, filed on Nov. 15, 1999.

(51) Int. Cl.[7] ..... E21B 33/038; E21B 33/04

(52) U.S. Cl. ..... 166/379; 166/88.4; 166/95.1

(58) Field of Search ..... 166/379, 95.1, 166/88.1, 88.4, 84.1, 86.1, 86.3

(56) References Cited

U.S. PATENT DOCUMENTS

| | | | | |
|---|---|---|---|---|
| 557,533 A | * | 4/1896 | Morgan | 416/58 |
| 3,965,977 A | * | 6/1976 | Beson | 166/88.4 |
| 4,652,022 A | | 3/1987 | Nichols | 285/92 |
| 5,465,794 A | * | 11/1995 | McConaughy et al. | 166/375 |
| 5,555,935 A | | 9/1996 | Brammer et al. | 166/88.1 |
| 5,730,473 A | * | 3/1998 | Wilkins et al. | 166/88.4 |
| 5,988,282 A | * | 11/1999 | Jennings et al. | 166/348 |
| 6,047,776 A | | 4/2000 | Kiang et al. | 166/379 |
| 6,050,338 A | * | 4/2000 | Watkins | 166/348 |

FOREIGN PATENT DOCUMENTS

| | | | |
|---|---|---|---|
| GB | 2161188 A | 1/1986 | E21B/33/03 |

* cited by examiner

*Primary Examiner*—David Bagnell
*Assistant Examiner*—Daniel P Stephenson
(74) *Attorney, Agent, or Firm*—Bracewell & Patterson, L.L.P.

(57) ABSTRACT

A tubing hanger and wellhead have features for controlling and monitoring fluid pressure to downhole equipment. The tubing hanger has an internal vertical passage. A hydraulic line connects to the lower end of the vertical passage and runs downhole. The vertical passage communicates with a lateral passage through the outer wall of the hanger. A lateral passage through the wellhead housing is generally aligned with the lateral passage of the hanger when the hanger is installed in the wellhead housing. A pressure shaft is installed in the wellhead passage and has a passage therethrough. A seal member having spherical ends is inserted between spherical receptacles located on the inner end of the pressure shaft passage and on the outer end of the lateral passage of the hanger. The seal member has an internal passage having a flared inner end. The seal member is allowed to rotate to sealingly connect the lateral passages if some misalignment of the lateral passages exists. A gage or other pressure monitoring device or a source of hydraulic pressure can be attached to the outer end of the pressure shaft to communicate with the shaft passage.

21 Claims, 2 Drawing Sheets

TUBING HEAD CONTROL AND PRESSURE MONITOR DEVICE

CROSS REFERENCE TO RELATED APPLICATIONS

Benefit is herein claimed of the filing date under 35 USC § 119 and/or § 120 and CFR 1.78 to United States Provisional Patent Application Serial No. 60/165,507, filed on Nov. 15, 1999, entitled "Tubing Head Control and Pressure Monitor Device."

BACKGROUND OF THE INVENTION

1. Field of the Invention

This invention relates in general to wellhead assemblies and in particular to providing fluid pressure to a control line through connected passages in a tubing hanger and a wellhead housing.

2. Description of the Prior Art

In oil and gas wells where the wellhead is located at surface level, a tubing hanger will land within a tubing head. The-tubing hanger is located at the upper end of one or more strings of tubing through which production fluids will pass. A passage is typically provided in the tubing hanger to accommodate a control line that may be provided for control of a sub-surface safety valve or other downhole equipment. The valve must have fluid pressure applied to keep the valve open, and the pressure needs to be monitored to ensure the valve remains in an open position.

In related art applications, a control line passage is formed in a tubing hanger and is substantially parallel to the longitudinal axis of the tubing hanger. For small bore tubing heads, this arrangement results in an undesirable sharp right angle bend of the control tubing. The passage would extend completely through the hanger, and lines would connect to the bottom and to the top. The top line has to be coiled and passed out through a port in the wellhead.

SUMMARY OF THE INVENTION

A device is provided for controlling and monitoring the fluid pressure to downhole equipment. A tubing hanger is provided with an internal vertical passage. A hydraulic line connects to the lower end of the vertical passage and runs downhole. The vertical passage communicates with a lateral passage through the outer wall of the hanger. A lateral passage through the wellhead housing is generally aligned with the lateral passage of the hanger when the hanger is installed in the wellhead housing. A pressure shaft is installed in the wellhead passage and has a passage therethrough. A seal member having spherical ends is inserted between spherical receptacles located on the inner end of the pressure shaft passage and on the outer end of the lateral passage of the hanger. The seal member has an internal passage having a flared inner end. The seal member is allowed to rotate to sealingly connect the lateral passages, though some misalignment of the lateral passages exists. A gage or other pressure monitoring device or a source of hydraulic pressure can be attached to the outer end of the pressure shaft to communicate with the shaft passage.

DESCRIPTION OF THE DRAWINGS

The novel features believed to be characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DESCRIPTION OF THE INVENTION

Figure 1:
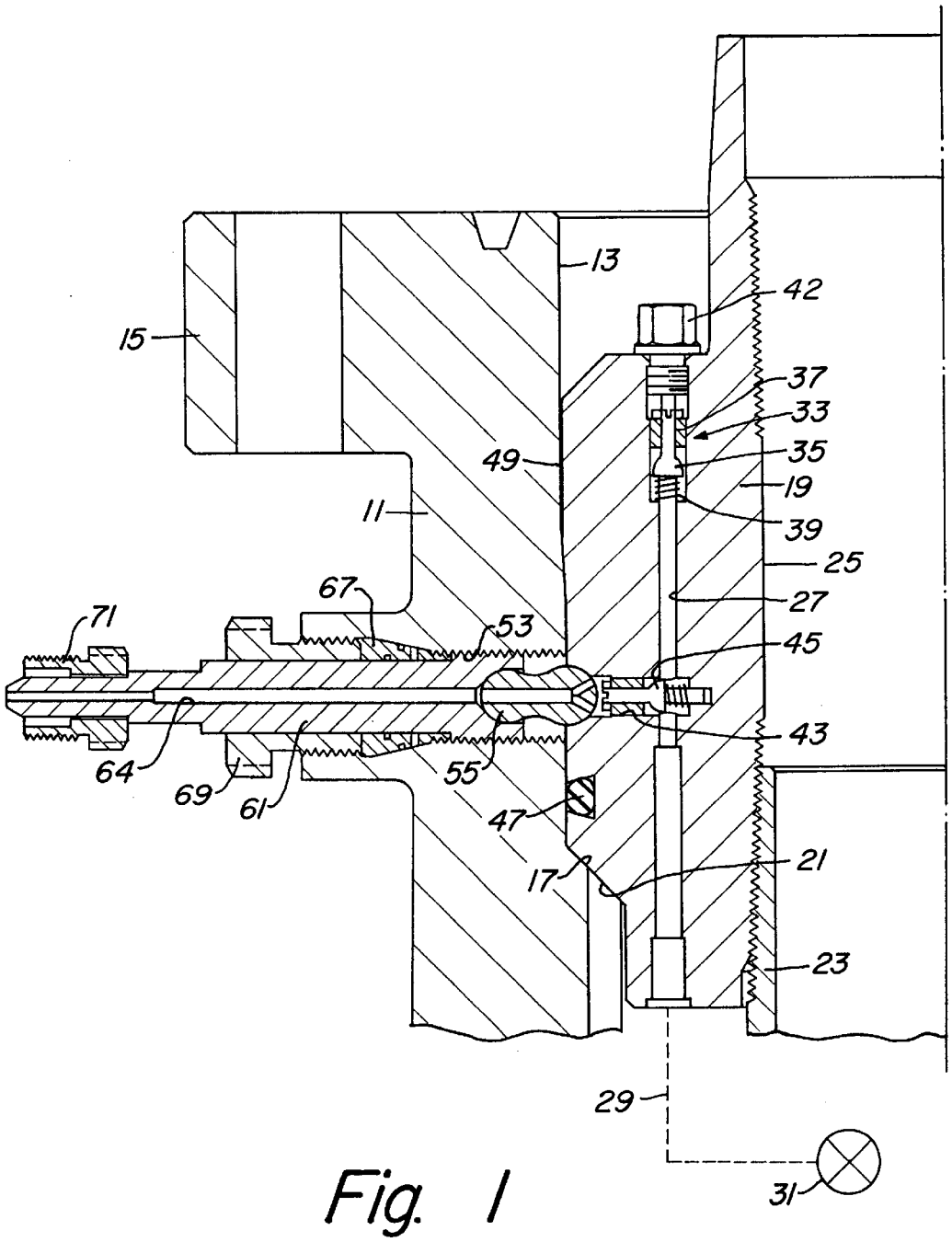
FIG. 1 is a quarter sectional view of a wellhead having a control and pressure monitor device in accordance with the invention.

Referring to FIG. 1, wellhead housing or tubing head 11 is a located at the upper end of a well. Tubing head 11 has a bore 13. An external flange 15 on tubing head 11 allows connection to a bonnet or other tubular structure located above. Bore 13 has a conical load shoulder 17 formed therein.

In FIG. 1, a tubing hanger 19 is shown landed in bore 13. Tubing hanger 19 has a downward facing shoulder 21 that lands on load shoulder 17. A string of production tubing 23 secures to tubing hanger 19. Tubing hanger 19 has a bore 25 extending axially through it that registers with the interior of production tubing 23 for the production of well fluids.

Tubing hanger 19 has at least one axially extending passage 27 that extends through it. Typically there will be more than one. Each passage 27 extends parallel and offset to tubing hanger bore 25. A hydraulic line 29 secures to the lower end of passage 27. Line 29 extends down alongside tubing 23 and connects to a device that requires hydraulic fluid pressure. In this embodiment, hydraulic line 29.is shown connected to a downhole safety valve 31. Valve 31 will be located in the string of tubing 23 a selected distance below the upper end of the well. Valve 31 is typically of a type that will remain in an open position as long as hydraulic fluid pressure is supplied through line 29 and will close when hydraulic fluid pressure is interrupted.

An upper check valve 33 is located near the upper end of passage 27 for allowing hydraulic fluid pressure to be introduced into passage 27, but preventing reverse flow. Upper check valve 33 is of a conventional type. In the embodiment shown, it has a plunger 35 that is moveable relative to a seat 37. Clearances exist around the cylindrical portion of plunger 35 that passes through seat 37. A spring 39 urges a seal portion of plunger 35 against seat 37 to prevent flow of hydraulic fluid from passage 27.

Figure 3:
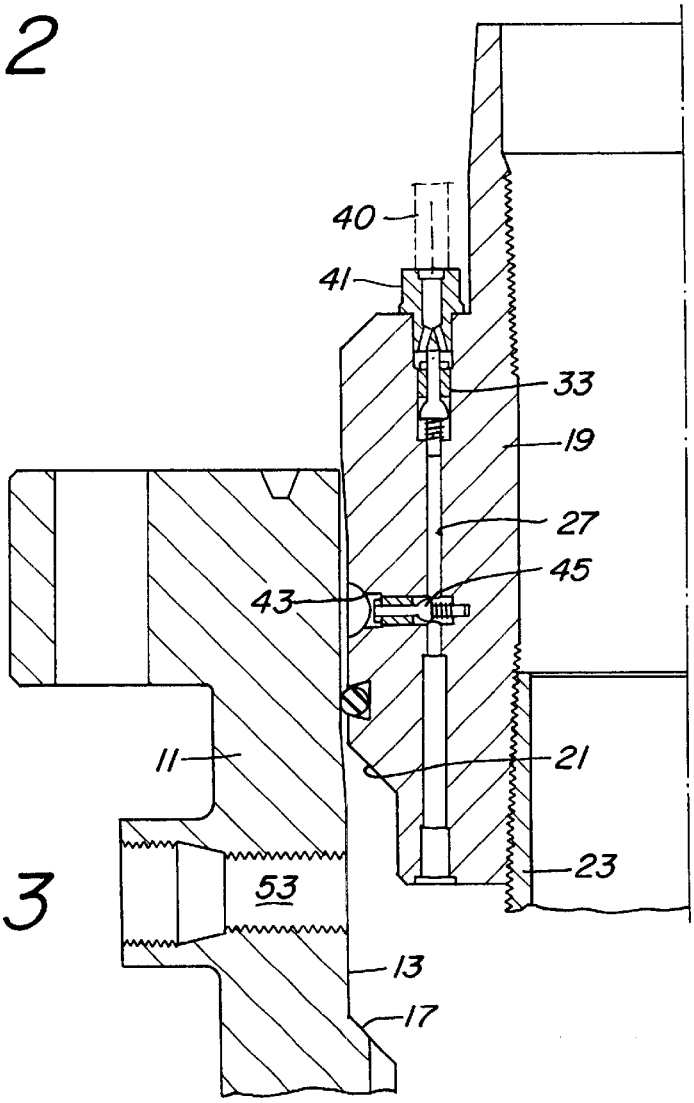
FIG. 3 is a view similar to FIG. 1, but showing the tubing hanger in the process of being landed in the tubing head.

Referring to FIG. 3, initially, hydraulic fluid pressure will be supplied to passage 27 through a line 40 and a conventional installation adapter 41 that is secured to threads at the upper end of passage 27 above check valve 33. Hydraulic fluid flows through installation adapter 41 and check valve 33 to open valve 31. This procedure typically will occur prior to landing tubing hanger 19 in tubing head 11. After landing as shown in FIG. 1, adapter 41 may be unscrewed and replaced with a blanking plug 42. Preferably blanking plug 42 moves plunger 35 downward to open check valve 33 once installed.

Referring again to FIG. 1, a lateral passage 43 extends radially from passage 27 to the exterior of tubing hanger 19. A check valve 45 locates in lateral passage 43 for blocking outward flow of hydraulic fluid through lateral passage 43, but admitting inward flow. Check valve 45 may be identical to check valve 33. Check valve 45 does not block flow through passage 27, although its plunger and spring do extend through passage 27. An elastomeric seal 47 extends around the exterior of tubing hanger 19 below lateral passage 43. A metal seal surface 49 is formed on the exterior of tubing hanger 19 above lateral passage 43 for forming a metal-to-metal seal with bore 13.

Figure 2:
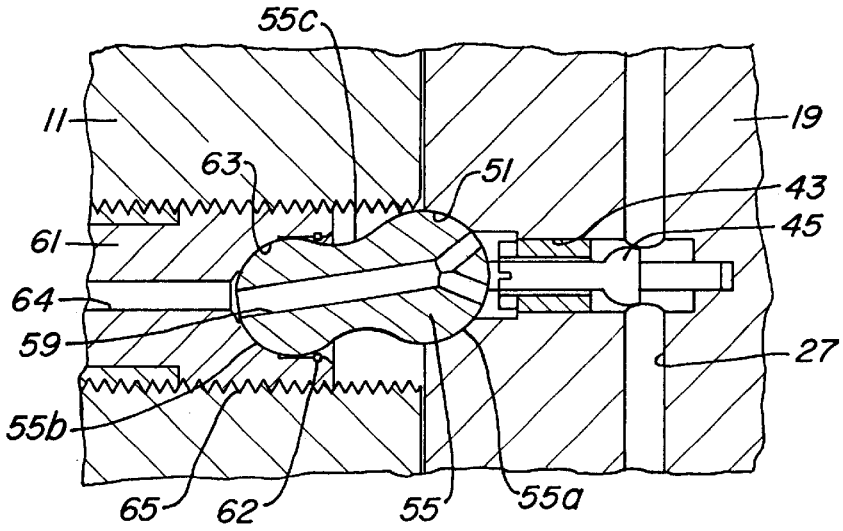
FIG. 2 is an enlarged sectional view of a portion of the pressure and control monitor device of FIG. 1.

Referring to FIG. 2, a concave recess 51 is formed at the outer end of lateral passage 43. A lateral passage 53 extends through tubing head 11 for aligning and registering with lateral passage 27. Tubing head 11 and tubing hanger 19 will have an orientation device (not shown) to assure rotational alignment of passages 43 and 53 when landing tubing hanger 19. A seal member 55 is carried in lateral passage 53. Seal member 55 is generally a peanut-shaped metal member having a longitudinal axis. It has an inner spherical end 55*a* and an outer spherical end 55*b,* with outer end 55*b* being of smaller diameter than inner end 55*a* in the embodiment shown. Also, it preferably has a waist 55*c* located between the two ends 55*a,* 55*b,* waist 55*c* being smaller in diameter than either of the ends. A passage 59 extends longitudinally through seal member 55, and passage 59 may be flared or have multiple outlets on inner end 55*a* . The cross-sectional dimension of the outer end of passage 43 is larger than the cross-sectional dimension of the flared inner end or multiple outlets of passage 59. Inner end 55*a* of seal member 55 engages concave recess 51 in a metal-to-metal seal sealing engagement. Inner end 55*a* also depresses the plunger in check valve 45 cause it to open.

A shaft or pressure tube 61 extends from seal member 55 outward through lateral passage 53. Pressure tube 61 has a concave recess 63 that sealingly engages outer end 55*b* of seal member 55 in a metal-to-metal sealing engagement. A small retainer ring 62 encircling recess 63 secures seal member 55 to pressure tube 61, but allows rotational movement of seal member 55 relative to pressure tube 61. Pressure tube 61 has a longitudinal passage 64 and threads 65 that engage threads located in lateral passage 53. Referring to FIG. 1, a conical seal 67 surrounds pressure tube 61 and locates within a conical portion formed in passage 53. Conical seal 67 forms a metal-to-metal seal between pressure tube 61 and the conical portion of lateral passage 53. A nut 69 engages threads at the outer end of lateral passage 53 and bears against conical seal 67 to cause the sealing engagement. An adapter fitting 71, which may be of various types, is on the outer end of pressure tube 61. Adapter fitting 71 may connect to a variety of hydraulic devices, such as a gage, valve or a source of hydraulic fluid pressure.

During running of tubing hanger 19, line 29 will be connected to valve 31 as the string of tubing 23 is lowered into the well. After tubing hanger 19 is made up to the upper end of the string of tubing 23, line 29 is connected to tubing hanger 19 and hydraulic fluid pressure is preferably introduced in. passage 27 as illustrated in FIG. 3. The introduction of hydraulic fluid pressure is through line 40 and adapter fitting 41. Lower check valve 45 prevents the outward flow of hydraulic fluid pressure in line 27. As tubing hanger 19 nears tubing head 11, it will appear as shown in FIG. 3. Seal member 55 and pressure tube 61 may be located in lateral passage 53 prior to running of hanger 19 but must be backed off from the fully inserted position, or tube 61 and seal member 55 can be inserted after hanger 19 is landed. After tubing hanger 19 has been landed and locked down by a conventional locking device (not shown), seal member 55 is inserted into concave recess 63, and pressure tube 61 is inserted into lateral passage 53. Retainer ring 62 will hold seal member 55 with pressure tube 61 during the insertion.

The operator will have a means to orient tubing hanger 19 rotationally so that lateral passages 43 and 53 are in general alignment. However, due to tolerances, lateral passage 43 may be spaced axially above or below lateral passage 53. In FIG. 2, passage 43 is shown spaced slightly above passage 53. As seal member 55 is pressed into engagement with concave recess 51, it will rotate slightly as shown in FIG. 2. The longitudinal axis of seal member 55 will thus be skewed relative to the longitudinal axis of passage 53. Misalignment up to ⅛ inch is allowed in the preferred embodiment.

As the inner end 55*a* of seal member 55 enters concave recess 51, it will depress the plunger of check valve 45, opening check valve 45. This admits hydraulic fluid to passage 64. The outer end will normally be connected to a gage, pump, valve or some other hydraulic device. Seal member 55 will not open check valve 45 until pressure tube 61 has been tightened sufficiently to form a seal from the spherical sealing surfaces 63, 55*b* and 55*a,* 51. After pressure tube 61 has been tightened, the operator tightens nut 69 to form the seal at conical seal 67. The operator may now change the hydraulic fluid pressure in line 29, monitor the hydraulic fluid pressure in line 29 or perform other hydraulic functions via lateral passages 43 and 53. A bonnet or other type of closure member will connect to flange 15 of tubing head 11.

While the invention is shown in only one of its forms, it should be apparent to those skilled in the art that it is not so limited, but is susceptible to various changes without departing from the scope of the invention.

What is claimed is:

1. In a wellhead assembly having an outer tubular member with an axial bore, an inner tubular member landed in the bore, the inner tubular member having a lateral flow passage with a port on an outer wall of the inner tubular member, the improvement comprising:

a lateral bore formed in the outer tubular member in general alignment with the lateral passage in the inner tubular member;

a shaft releasably secured in the lateral bore, the shaft having a passage therethrough and a port on an outer end;

a rigid seal member having one end that abuts the port in the shaft and another end that abuts the port in the inner tubular member, the seal member having an internal passage therethrough for communicating fluid between the passage in the shaft and the lateral passage in the inner tubular member; and wherein the seal member ends define sealing interfaces with the ports, each of the interfaces being partially spherical to allow some misalignment between the port of the shaft and the port of the inner tubular member.

2. The wellhead assembly of claim 1, wherein:

the internal passage of the seal member has a flared inner end.

3. The wellhead assembly of claim 1, wherein:

the ends of the seal member are convex and the ports are concave.

4. The wellhead assembly of claim 1, wherein:

the inner tubular member further comprises a vertical fluid passage in fluid communication with the lateral passage of the inner tubular member.

5. The wellhead assembly of claim 1, further comprising:

a check valve located in the lateral fluid passage of the inner tubular member and positioned to be moved to an open position by contact with the seal member.

6. The wellhead assembly of claim 1, wherein:

a cross-sectional dimension of the lateral fluid passage of the inner tubular member is greater at the sealing interface than a cross-sectional dimension of the inner end of the internal passage of the seal member.

7. The wellhead assembly of claim 1, further comprising:

a downhole safety valve suspended below the inner tubular member and in communication with the lateral flow passage in the inner tubular member for receiving hydraulic pressure through the lateral bore in the outer tubular member.

8. A wellhead assembly comprising:

a wellhead housing;

a lateral fluid passage located in the wellhead housing having a port on an inner end;

a hanger landed in the wellhead housing;

a lateral fluid passage located in the hanger and having a port on an exterior of the hanger; and a seal member having an inner end and an outer end, the inner end being in sealing engagement with the port of the hanger, the outer end being in sealing engagement with the port of the housing, the seal member also having an internal passage communicating the two ends, each of the ends and each of the ports being partially spherical to accommodate some misalignment between the ports.

9. The wellhead assembly of claim 8, wherein:

the internal passage of the seal member has a flared inner end.

10. The wellhead assembly of claim 8, wherein:

the ends of the seal member are convex and the ports are concave.

11. The wellhead assembly of claim 8, wherein:

the hanger further comprises a vertical fluid passage in fluid communication with the lateral passage of the hanger.

12. The wellhead assembly of claim 8, further comprising:

a check valve located in the lateral fluid passage of the hanger and positioned to be moved to an open position by contact with the seal member.

13. The wellhead assembly of claim 8, wherein:

a cross-sectional dimension of the lateral fluid passage of the hanger is greater at the port of the hanger than a cross-sectional dimension of the inner end of the internal passage of the seal member.

14. The wellhead assembly of claim 8, wherein:

the lateral fluid passage of the wellhead housing is located within a tubular member releasably secured in a lateral bore in the wellhead housing, the spherical receptacle in the wellhead being located on an inner end of the shaft.

15. The wellhead assembly of claim 8, further comprising:

a downhole safety valve suspended below the hanger and in communication with the lateral fluid passage in the hanger for receiving hydraulic pressure through the lateral flow passage in the wellhead housing.

16. A wellhead assembly comprising:

a wellhead housing;

a lateral fluid passage located in the wellhead housing having a port on an inner end;

a hanger landed in the wellhead housing;

a lateral fluid passage located in the hanger and having a port on an exterior of the hanger;

a vertical fluid passage located in the hanger and in fluid communication with the lateral passage of the hanger;

a check valve located in the lateral fluid passage of the hanger and positioned to be moved to an open position by contact with the seal member;

a seal member having a partially-spherical inner end and a partially-spherical outer end, the inner end being in sealing engagement with the port of the hanger, the outer end being in sealing engagement with the port of the housing, the seal member also having an internal passage communicating the two ends, each of the ends and each of the ports being partially spherical to accommodate some misalignment between the ports; and a downhole safety valve suspended below the hanger and in communication with the vertical fluid passage in the hanger for receiving hydraulic pressure through the lateral flow passage in the wellhead housing.

17. The wellhead assembly of claim 16, wherein:

the internal passage has a flared inner end.

18. The wellhead assembly of claim 16, wherein:

the ends of the seal member are convex and the ports are concave.

19. The wellhead assembly of claim 16, wherein:

a cross-sectional dimension of the lateral fluid passage of the hanger is greater at the port of the lateral fluid passage than a cross-sectional dimension of the inner end of the internal passage of the seal member.

20. The wellhead assembly of claim 16, wherein:

the lateral fluid passage of the wellhead housing is located within a tubular member releasably secured in a lateral bore in the wellhead housing, the spherical receptacle in the wellhead being located on an inner end of the shaft.

21. A method of landing an inner tubular member in an outer tubular member of a wellhead housing and providing a fluid communication from the exterior of the outer tubular member to below the inner tubular member, the method comprising:

providing a lateral flow passage in the inner tubular member that communicates below the inner tubular member;

forming a lateral bore in the outer tubular member;

orienting the lateral bore in the outer tubular member with the lateral flow passage of the inner tubular member and landing the inner tubular member in the outer tubular member;

inserting an articulating seal member into the lateral bore of the outer tubular member and pushing it into sealing abutment with a port on an outer end of the lateral flow passage in the inner tubular member, the seal member articulating in the event of misalignment of the lateral bore and lateral flow passage; and sealing the seal member within the lateral bore of the outer tubular member.

* * * * *